US011673778B2

(12) United States Patent
Zhang et al.

(10) Patent No.: US 11,673,778 B2
(45) Date of Patent: Jun. 13, 2023

(54) UPRIGHT POST STRUCTURE AND AUTOMOBILE ELEVATOR

(71) Applicant: YINGKOU TIANZHOU TECHNOLOGY CO., LTD., Liaoning (CN)

(72) Inventors: Xiaoguang Zhang, Liaoning (CN); Yuzhu Wang, Liaoning (CN)

(73) Assignee: YINGKOU TIANZHOU TECHNOLOGY CO., LTD., Yingkou (CN)

( * ) Notice: Subject to any disclaimer, the term of this patent is extended or adjusted under 35 U.S.C. 154(b) by 559 days.

(21) Appl. No.: 16/816,123

(22) Filed: Mar. 11, 2020

(65) Prior Publication Data

US 2021/0221661 A1 Jul. 22, 2021

(30) Foreign Application Priority Data

Jan. 20, 2020 (CN) ..... 202020136920.7

(51) Int. Cl.

| | |
|---|---|
| ***B66F 7/28*** | (2006.01) |
| ***B66F 13/00*** | (2006.01) |
| ***E04H 12/00*** | (2006.01) |
| ***E04H 12/08*** | (2006.01) |

(52) U.S. Cl.

CPC ..... *B66F 7/28* (2013.01); *B66F 13/00* (2013.01); *E04H 12/00* (2013.01); *E04H 12/08* (2013.01); *B66F 2700/123* (2013.01)

(58) Field of Classification Search

None

See application file for complete search history.

(56) References Cited

U.S. PATENT DOCUMENTS 5,009,287 A * 4/1991 Starr ..... B66F 7/04 254/89 R
5,284,226 A * 2/1994 Makimura ..... F16C 29/005 187/408
5,318,154 A * 6/1994 Hellman, Jr. ..... B66F 7/02 187/203

(Continued)

FOREIGN PATENT DOCUMENTS

CN 304886702 S 11/2018
CN 305092078 S 4/2019

(Continued)

*Primary Examiner* — Joshua K Ihezie

(74) *Attorney, Agent, or Firm* — McCoy Russell LLP

(57) ABSTRACT

The invention relates to the field of automobile elevators. An upright post structure is provided, wherein the upright post structure is a polygonal columnar structure formed by bending a plate, the upright post structure comprises a back plate, both ends of the back plate in a width direction vertically extend toward the same side of the back plate to form a side plate, end parts of the side plate away from the back plate extend oppositely to form a front plate, wherein the upright post structure further comprises one or a combination of various. Thus, when the upright post structure is subjected to a force in a horizontal direction, the local stress of the upright post is transferred so that the strength of the upright post is improved. The invention further provides automobile elevator using the upright post structure.

8 Claims, 6 Drawing Sheets

(56) References Cited

U.S. PATENT DOCUMENTS

| | | | | |
|---|---|---|---|---|
| 6,279,685 | B1 * | 8/2001 | Kogan | B66F 7/20 187/203 |
| 11,434,118 | B2 * | 9/2022 | Zhang | B66F 7/28 |
| 2009/0321189 | A1 * | 12/2009 | Schmitt | B66F 7/065 187/215 |

FOREIGN PATENT DOCUMENTS

| | | | |
|---|---|---|---|
| KR | 100703766 | B1 | 3/2007 |
| TW | 491780 | B | 6/2002 |

* cited by examiner

UPRIGHT POST STRUCTURE AND AUTOMOBILE ELEVATOR

CROSS REFERENCE TO RELATED APPLICATIONS

The present application claims priority to Chinese Patent Application No. 202020136920.7, entitled "UPRIGHT POST STRUCTURE AND AUTOMOBILE ELEVATOR", and filed on Jan. 20, 2020. The entire contents of the above-listed application is hereby incorporated by reference for all purposes.

FIELD OF THE INVENTION

The invention relates to the field of bearing structural parts, in particular to an upright post structure.

BACKGROUND OF THE INVENTION

An automobile elevator is an important auxiliary device in the field of automobile warranty service and is a basis for automobile repair, maintenance and care. It may lift an automobile to a certain height, so that the tires of the automobile deviate from the ground, and then, an operator may work on the tires; or the automobile elevator enables an automobile chassis to leave the ground for an enough space, so that the operator may work at the bottom of the automobile. Therefore, the safety of the automobile in a lifting process, and the safety of the automobile in the air after the elevator lifts the automobile to the required height are the most important performance indicator of the automobile elevator. In the lifting process of the automobile and when the automobile in the air, the weight of the automobile itself acts on an upright post of the elevator at last through force transfer. Therefore, the strength of the upright post of the elevator is a precondition of the safety performance of the elevator.

The existing upright post of the automobile elevator has many structural design styles, generally, there are two main design directions, one is to improve the strength of the upright post by increasing the thickness of the material of the upright post structure of the automobile elevator, and the other is to improve the strength of the upright post by adding some reinforcing ribs on the upright post structure. The two methods have a common shortcoming of increasing the loss of raw materials. Therefore, the development of an upright post structure that not only saves raw material loss, but also can improve the strength of the upright post is the source power for promoting the continuous development of the automobile elevator technology.

SUMMARY OF THE INVENTION

In order to solve the above problems, the invention provides an upright post structure. By means of multiple included angles formed by bending the upright post structure, when the upright post structure is subjected to a component force in a horizontal direction provided by an external force, the component force can be decomposed by the multiple included angles and edgefolds, so that the local stress of the upright post is transferred, the local stress is reduced, and the strength of the upright post is improved by changing the upright post structure. The invention further provides automobile elevator using the upright post structure.

In order to achieve the above objective, the invention adopts the following technical solutions:

In a first technical solution, an upright post structure is provided, wherein the upright post structure is a polygonal columnar structure formed by bending a plate, the upright post structure comprises a back plate, both ends of the back plate in a width direction vertically extend toward the same side of the back plate to form a side plate, and end parts of the side plate away from the back plate extend oppositely to form a front plate, wherein the upright post structure further comprises one or a combination of at least two of the following features:

a joint of the side plate and the front plate is bevelled, and an extension surface formed at the bevelled location is a front sloping plate, wherein an included angle between the front plate and the side plate has a buffer structure, and the buffer structure is used for reducing the possibility of deformation or deformation degree of the side plate caused by an external force;

the back plate has a first groove for enhancing the strength of the upright post and installing wirings and an electromagnetic lock; and the side plate has a folded-back structure, and the folded-back structure is a groove structure or a convex structure.

In the first technical solution, preferably, the upright post structure further comprises an edgefold formed at an included angle between the front plate and the side plate, and the front plate, the side plate and the edgefold are enclosed to form a closed structure as the buffer structure, wherein an end section or a part of an extended section of the edgefold abuts against the side plate or the front plate.

In the first technical solution, preferably, an inner side of the front plate extends toward a direction vertical to the back plate to form a first edgefold, one side of the first edgefold facing to the back plate extends toward the side plate to form a second edgefold, one side of the second edgefold facing to the side plate extends toward the front plate to form a third edgefold, the third edgefold abuts against an inner wall of the side plate, and the first edgefold, the second edgefold and the third edgefold form the buffer structure.

In the first technical solution, preferably, the upright post structure includes a first structural member which is a columnar body formed by the back plate, the side plate and the front plate and a second structural member which is a columnar structure formed by bending a plate, wherein the inner side of the front plate extends toward the direction vertical to the back plate to form a first edgefold and the second structural member comprises a fourth edgefold, a fifth edgefold, a sixth edgefold and a seventh edgefold, wherein one side of the fourth edgefold is bent in a direction vertical to the fourth edgefold to form the fifth edgefold, one side of the fifth edgefold away from the fourth edgefold is bent in a direction vertical to the fifth edgefold to form the sixth edgefold, the sixth edgefold and the fourth edgefold are located on the same side of the fifth edgefold, one side of the sixth edgefold away from the fifth edgefold is bent in a direction vertical to the sixth edgefold to form the seventh edgefold, and the seventh edgefold and the fifth edgefold are located on the same side of the sixth edgefold; and the second structural member may be inserted at a semi-surrounding structure enclosed by the side plate, the front plate and the first edgefold, the fourth edgefold abuts against the inner side of the front plate, the fifth edgefold abuts against the inner side of the first edgefold, and the seventh edgefold abuts against the inner side of the side plate.

In the first technical solution, preferably, when the second structural member and the first structural member are cooperatively installed, a free end part of the seventh edgefold is located at the joint of the side plate and the front sloping plate.

In the first technical solution, preferably, the included angle formed by the side wall formed by the folded-back structure and the main extension surface where the folded-back structure is located has a chamfer structure.

In the first technical solution, preferably, the upright post structure is a symmetrical structure along a plane vertical to a longitudinal center of the back plate.

In the first technical solution, preferably, when the upright post does not have the front sloping plate, a tail end of the front plate is bent toward a direction away from the back plate to form an eighth edgefold, an end part of the eighth edgefold away from the front plate is bent toward a direction away from the side plate to form a ninth edgefold, an edge of the ninth edgefold away from the side plate is bent toward a direction away from the back plate to form a tenth edgefold, and an edge of the tenth edgefold close to the back plate is bent toward the direction of the side plate to form an eleventh edgefold, the eleventh edgefold abuts against the back surface of the front plate, the eighth edgefold, the ninth edgefold, the tenth edgefold and a part of segments of the eleventh edgefold are enclosed to form a rectangular structure, and the free end part of the eleventh edgefold abuts against the inner wall of the side plate.

In the first technical solution, preferably, when the upright post does not have the front sloping plate, the tail end of the front plate is bent toward a direction away from the back plate to form an eighth edgefold, an end part of the eighth edgefold away from the front plate is bent toward a direction away from the side plate to form a ninth edgefold, an edge of the ninth edgefold away from the side plate is bent toward a direction away from the back plate to form a tenth edgefold, and an edge of the tenth edgefold close to the back plate is bent toward the direction of the side plate to form an eleventh edgefold, an end part of the eleventh edgefold close to the side plate is bent toward the front plate to form a twelfth edgefold, a part of the surface of the twelfth edgefold abuts against the inner side of the side plate, and the free end part of the twelfth edgefold abuts against the included angle of the side plate and the front plate.

In a second technical solution, an automobile elevator includes the upright post structure according to any item in the first technical solution.

The beneficial effects of using the invention include:

By means of the optimization design of the upright post structure, when the upright post structure is subjected to the component force in the horizontal direction provided by the external force, the force bearing points are decomposed from one to two force bearing points into a plurality of force bearing points, so that the external force is dispersed to various plates of the upright post, and the stress concentration phenomenon is not obvious. The stress directions on various edges of the upright post are changed by these bent designs, the force acting on the upright post may be distributed to the edges in various directions of the upright post by using the principle of force decomposition and synthesis, in this way, the edges in various directions of the upright post achieve an overall stress effect to prevent the situation that the stress of the various edges of the upright post is non-uniform, such that the stress at a certain location is too excessive to exceed a bearing limit of the upright post, then the upright post loses the bearing capability; the edgefolds formed by bending the back plate and the side plate of the upright post reinforce the back surface and the side face of the upright post; and meanwhile, the groove in the back surface of the upright post can also be used for arranging other accessories of the automobile elevator due to the enough inner space, so that the space is utilized reasonably, and the whole machine structure is compact.

REFERENCE SIGNS

1-back plate, 2-side plate, 3-front plate, 41-front sloping plate, 42-back sloping plate, 5-first edgefold, 6-second edgefold, 7-third edgefold, 10-first structural member, 20-second structural member, 21-fourth edgefold, 22-fifth edgefold, 23-sixth edgefold, 24-seventh edgefold; 25-eighth edgefold, 26-ninth edgefold, 27-tenth edgefold, 28-eleventh edgefold, 29-twelfth edgefold.

11-first groove, 12-second groove.

DETAILED DESCRIPTION OF THE EMBODIMENTS

In order to make the objectives, technical solutions and advantages of the technical solutions be clearer, the technical solutions are further described in detail below in conjunction with the specific embodiments. It should be understood that these descriptions are only exemplary and are not intended to limit the scope of the technical solutions.

Embodiment 1

Figure 1:
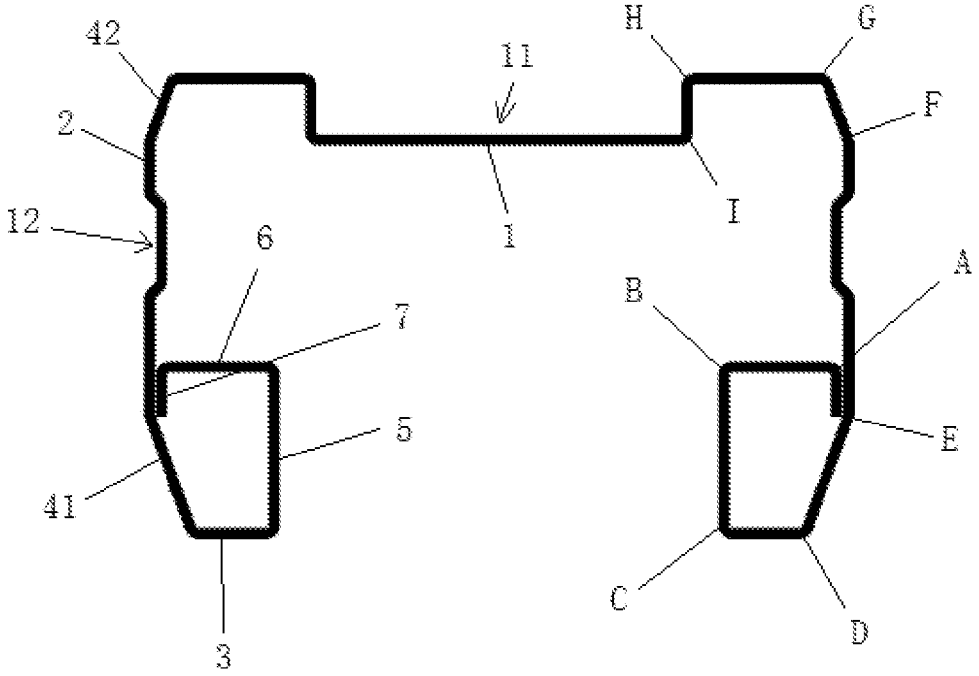
FIG. 1 is a schematic diagram of a cross section in embodiment 1 of an upright post structure of the invention.

As shown in FIG. 1, the present embodiment provides an upright post structure. The upright post structure is a columnar structure formed by bending a plate, the upright post structure includes a back plate 1, both ends of the back plate 1 in a width direction vertically extend toward the same side of the back plate 1 to form a side plate 2, and end parts of the side plate 2 away from the back plate 1 extend oppositely to form a front plate 3, wherein a joint of the back plate 1 and the side plate 2 is bevelled, and an extension surface formed at the bevelled location is a back sloping plate 42; a joint of the side plate 2 and the front plate 3 is bevelled, and the extension surface formed at the bevelled location is a front sloping plate 41; and non-vertical bending angles are formed at the joint of the back plate 1 and the back sloping plate 42, the joint of the back sloping plate 42 and the side plate 2, the joint of the side plate 2 and the front sloping plate 41, and the joint of the front sloping plate 41 and the front plate 3.

It may be understood that, when an upright post is extruded by an inner sliding block, the stress concentration generated by the stress is mainly distributed at an included angle D, an included angle E, an included angle F and an included angle G. When the upright post is impacted by a front face or a back surface, the stress concentration is mainly distributed at the included angle F, the included angle G, the included angle E and the included angle D. Therefore, the stress is dispersed, and the stress concentration phenomenon is not obvious.

The included angle between the front plate 3 and the side plate 2 has a buffer structure, and the buffer structure is used for reducing the possibility of deformation or deformation degree of the side plate 2 caused by an external force.

In the present embodiment, an inner side of the front plate 3 extends toward a direction vertical to the back plate 1 to form a first edgefold 5, one side of the first edgefold 5 facing to the back plate 1 extends toward the side plate 2 to form a second edgefold 6, one side of the second edgefold 6 facing to the side plate 2 extends toward the front plate 3 to form a third edgefold 7, the third edgefold 7 abuts against an inner wall of the side plate 2, and the first edgefold 5, the second edgefold 6 and the third edgefold 7 form a buffer structure. The structure is as shown in FIG. 1.

After the buffer structure is added to the upright post structure, when the upright post is extruded by the inner sliding block, the stress concentration generated by the stress is mainly distributed at an included angle A, the included angle D, the included angle E, the included angle F and the included angle G, and a part of stress is dispersed at an included angle B and an included angle C. When the front face or the back surface of the upright post is extruded by the inner sliding block, the stress concentration is mainly distributed at the included angle F, the included angle G, the included angle E and the included angle D, and a part of stress is dispersed at the included angle B and the included angle C.

Preferably, the main extension surface of the back plate 1 has a folded-back structure, and in the present embodiment, the folded-back structure on the back plate 1 is a first groove 11. The main extension surface of the side plate 2 has a folded-back structure, and in the present embodiment, the folded-back structure on the side plate 2 is a second groove 12, and a projection structure symmetrical to the groove can be formed at the location of the second groove 12 in other embodiments. At this time, when the back plate 1 is extruded by the inner sliding block, the stress is also distributed to the groove and the bent location on the main extension surface where the groove is located. Taking the first groove 11 as an example, the stress is distributed to an included angle H and an included angle I. In other embodiments, the folded-back structure may also be a projection structure, the principle of which is consistent with that of the groove structure, and thus will not be described repeatedly herein.

Preferably, the included angle between a side wall formed by the folded-back structure and the main extension surface where the folded-back structure is located has a chamfer structure, that is, the stress between the wall formed by the folded-back structure and the main extension surface where the folded-back structure is located is further dispersed.

In the present embodiment, the upright post structure is a symmetrical structure along a plane vertical to a longitudinal center of the back plate 1. When the front face and the side face thereof are subjected to the external force, the external force is equally and symmetrically distributed to the left and right sides of the upright post structure, thereby avoiding included single stress concentration on a single side plate 2.

Figure 5:
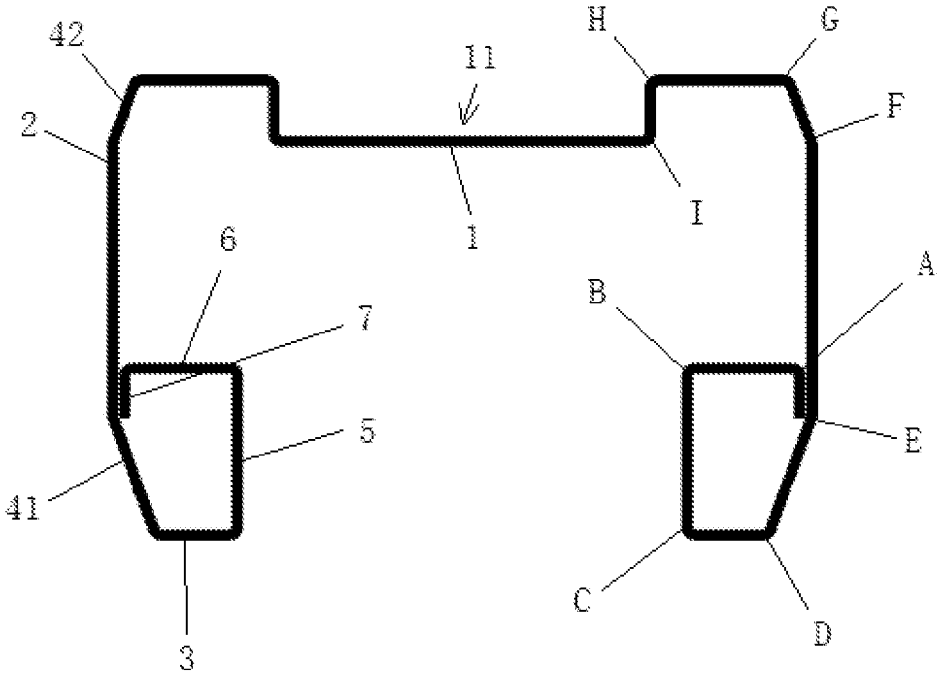
FIG. 5 is a schematic diagram of a cross section of a side plate without second groove in the embodiment 1 of the upright post structure of the invention.

In the present embodiment, the groove 12 may also be removed from the side plate 2, and the structure of which is as shown in FIG. 5.

Embodiment 2

The present embodiment is similar to the principle of the upright post structure in embodiment 1, and the present embodiment adopts a split structure to realize the effect of stress decomposition of the upright post structure in embodiment 1.

Figure 2:
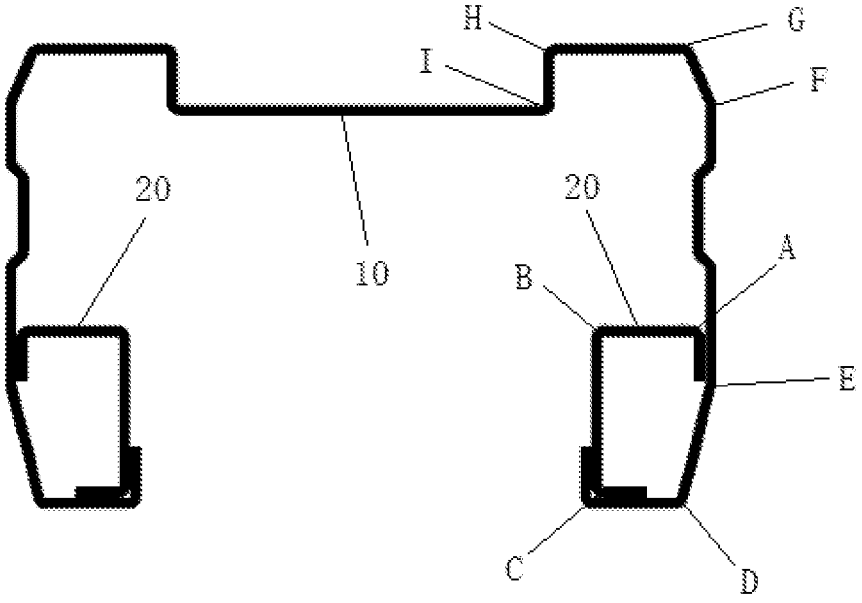
FIG. 2 is a schematic diagram of a cross section in embodiment 2 of an upright post structure of the invention.

The upright post structure includes a first structural member 10 and a second structural member 20, and the combination form thereof is as shown in FIG. 2. A columnar body formed by a back plate 1, a side plate 2 and a front plate 3 is the first structural member 10.

Figure 3:
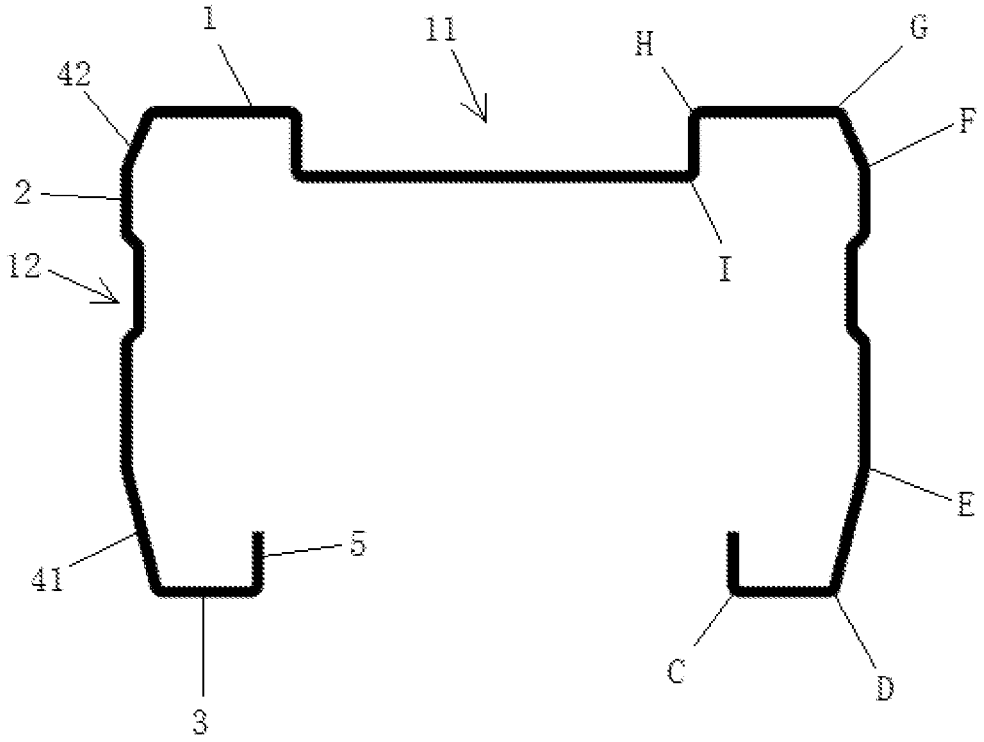
FIG. 3 is a schematic diagram of a cross section of a first structural member in the embodiment 2 of the upright post structure of the invention.

The structure of the first structural member 10 is as shown in FIG. 3. Both ends of the back plate 1 in a width direction vertically extend toward the same side of the back plate 1 to form the side plate 2, and end parts of the side plate 2 away from the back plate 1 extend oppositely to form the front plate 3. The joint of the back plate 1 and the side plate 2 is bevelled, and an extension surface formed at the bevelled location is a back sloping plate 42; and the joint of the side plate 2 and the front plate 3 is bevelled, and the extension surface formed at the bevelled location is a front sloping plate 41.

Figure 4:
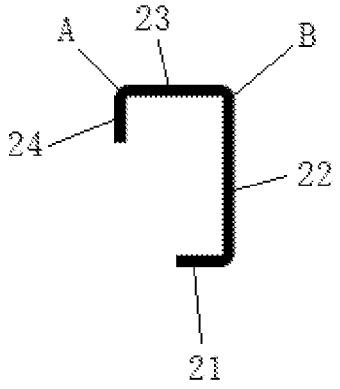
FIG. 4 is a schematic diagram of a cross section of a second structural member in the embodiment 2 of the upright post structure of the invention.

As shown in FIG. 4, an inner side of the front plate 3 extends toward the direction vertical to the back plate 1 to form the first edgefold 5. The second structural member 20 is a columnar structure formed by bending a plate, and the second structural member 20 includes a fourth edgefold 21, a fifth edgefold 22, a sixth edgefold 23 and a seventh edgefold 24, wherein one side of the fourth edgefold 21 is bent in a direction vertical to the fourth edgefold 21 to form the fifth edgefold 22, one side of the fifth edgefold 22 away from the fourth edgefold 21 is bent in a direction vertical to the fifth edgefold 22 to form the sixth edgefold 23, the sixth edgefold 23 and the fourth edgefold 21 are located on the same side of the fifth edgefold 22, one side of the sixth edgefold 23 away from the fifth edgefold 22 is bent in a direction vertical to the sixth edgefold 23 to form the seventh edgefold 24, and the seventh edgefold 24 and the fifth edgefold 22 are located on the same side of the sixth edgefold; and the second structural member 20 may be inserted at a semi-surrounding structure enclosed by the side plate 2, the front plate 3 and the first edgefold 5, the fourth edgefold 21 abuts against the inner side of the front plate 3, the fifth edgefold 22 abuts against the inner side of the first edgefold 5, and the seventh edgefold 24 abuts against the inner side of the side plate 2.

When the second structural member 20 and the first structural member 10 are cooperatively installed, a free end part of the seventh edgefold 24 is located at the joint of the side plate 2 and the front sloping plate 41.

As shown in FIG. 2, when the upright post is extruded by the inner sliding block, the stress concentration generated by the stress is mainly distributed at the included angle A, the included angle D, the included angle E, the included angle F and the included angle G, and a part of stress is dispersed at the included angle B, the included angle C, the included angle H and the included angle I. When the upright post is impacted by the front face or the back surface, the stress concentration is mainly distributed at the included angle F, the included angle G, the included angle E and the included angle D, and a part of stress is dispersed at the included angle B, the included angle C, the included angle H and the included angle I.

Figure 6:
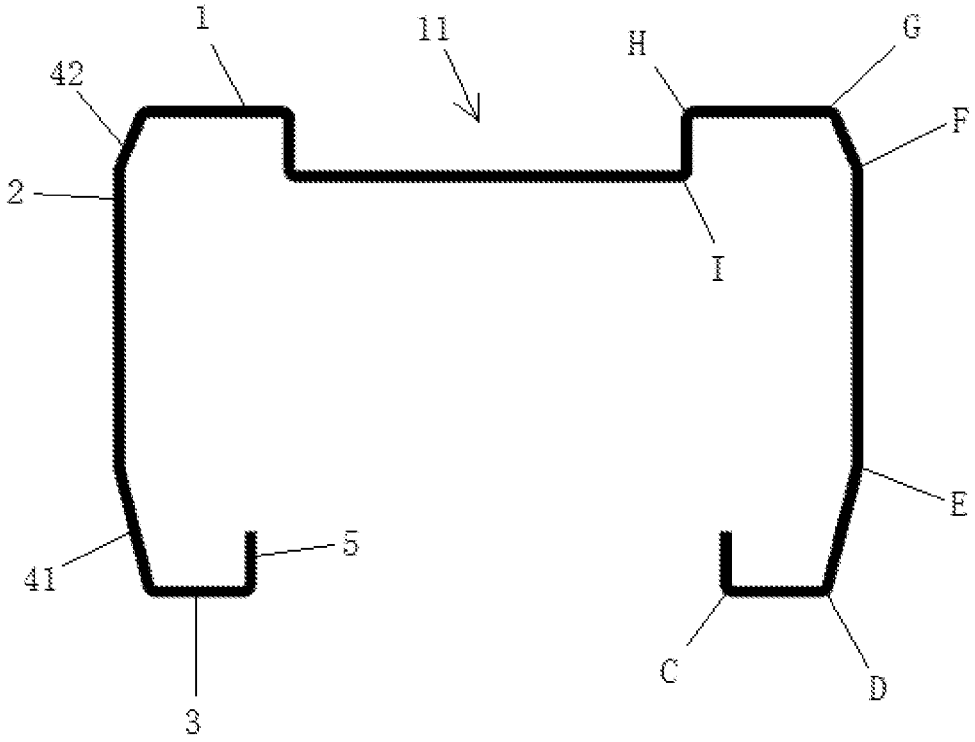
FIG. 6 is a schematic diagram of a cross section of a side plate without second groove in the embodiment 2 of the upright post structure of the invention.

In the present embodiment, the groove 12 may also be removed from the side plate 2, and the structure of which is as shown in FIG. 6.

With respect to the upright post structure provided in embodiment 1 and embodiment 2, when the upright post structure is subjected to the component force in the horizontal direction of any direction, the stress is distributed to at least 18 included angles, therefore, by means of the optimization design of the upright post structure of the device, when the upright post structure is subjected to the component force in the horizontal direction provided by the external force, the force bearing points are decomposed from one to two force bearing points into a plurality of force bearing points, so that the external force is dispersed to various plates of the upright post, and the stress concentration phenomenon is not obvious. The stress directions on various edges of the upright post are changed by these bent designs, the force acting on the upright post may be distributed to the edges in various directions of the upright post by using the principle of force decomposition and synthesis, in this way, the edges in various directions of the upright post achieve an overall stress effect to prevent the situation that the stress of the various edges of the upright post is non-uniform, such that the stress at a certain location is too excessive to exceed a bearing limit of the upright post, then the upright post loses the bearing capability; the edgefolds formed by bending the back plate 1 and the side plate 2 of the upright post reinforce the back surface and the side face of the upright post; and meanwhile, the groove in the back surface of the upright post can also be used for arranging other accessories of the automobile elevator due to the enough inner space, so that the space is utilized reasonably, and the whole machine structure is compact.

Embodiment 3

Figure 7:
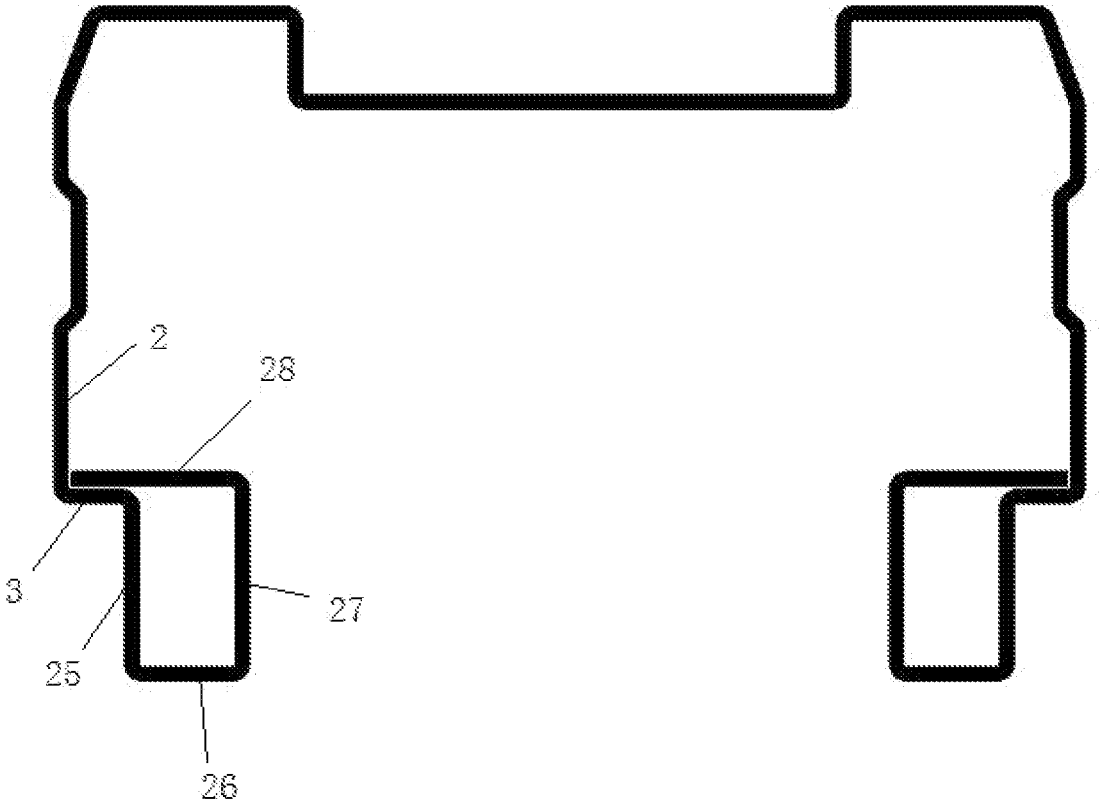
FIG. 7 is a schematic diagram of a cross section in embodiment 3 of an upright post structure of the invention.

As shown in FIG. 7, in the present embodiment, a tail end of the front plate 3 away from the side plate 2 has a buffer structure, and the buffer structure is used for reducing the possibility of deformation or deformation degree of the side plate 2 caused by an external force.

In the present embodiment, a tail end of the front plate 3 is bent toward a direction away from the back plate 1 to form an eighth edgefold 25, an end part of the eighth edgefold 25 away from the front plate 3 is bent toward a direction away from the side plate 2 to form a ninth edgefold 26, an edge of the ninth edgefold 26 away from the side plate 2 is bent toward a direction away from the back plate 3 to form a tenth edgefold 27, and an edge of the tenth edgefold 27 close to the back plate 1 is bent toward the direction of the side plate 2 to form an eleventh edgefold 28. The eleventh edgefold 28 abuts against the back surface of the front plate 3, and the eighth edgefold 25, the ninth edgefold 26, the tenth edgefold 27 and a part of segments of the eleventh edgefold 28 are enclosed to form a rectangular structure. In addition, a free end part of the twelfth edgefold 28 abuts against the inner side wall of the side plate 2.

Embodiment 4

The upright post structure in the present embodiment is similar to the upright post structure in embodiment 3, and the difference lies in the specific structure of the buffer structure.

Figure 8:
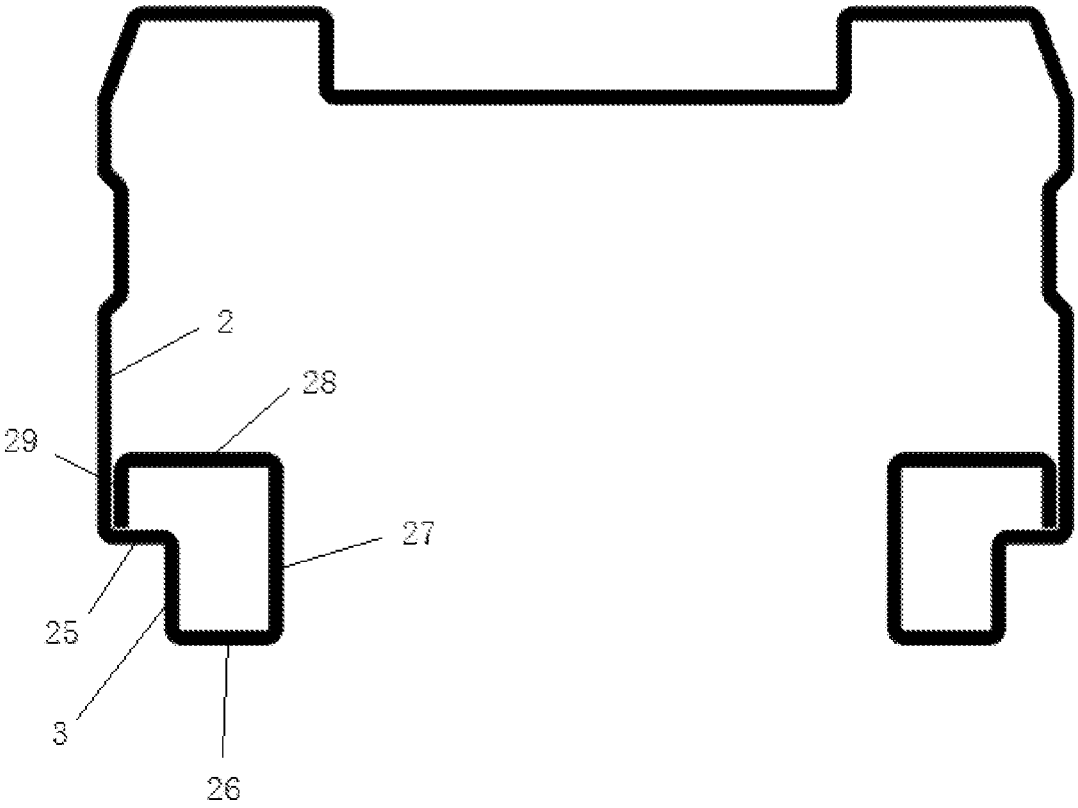
FIG. 8 is a schematic diagram of a cross section in embodiment 4 of an upright post structure of the invention.

As shown in FIG. 8, in the present embodiment, a tail end of the front plate 3 of the upright post structure is bent toward a direction away from the back plate 1 to form an eighth edgefold 25, an end part of the eighth edgefold 25 away from the front plate 3 is bent toward a direction away from the side plate 2 to form a ninth edgefold 26, an edge of the ninth edgefold 26 away from the side plate 2 is bent toward a direction away from the back plate 3 to form a tenth edgefold 27, an edge of the tenth edgefold 27 close to the back plate 1 is bent toward the direction of the side plate 2 to form an eleventh edgefold 28, an end part of the eleventh edgefold 28 close to the side plate 2 is bent toward the front plate 3 to form a twelfth edgefold 29, a part of the surface of the twelfth edgefold 29 abuts against the inner side of the side plate 2, and the free end part of the twelfth edgefold 29 abuts against the included angle of the side plate 2 and the front plate 3.

Embodiment 5

The present embodiment provides an automobile elevator, including the upright post structure in any one of embodiment 1, embodiment 2, embodiment 3 and embodiment 4, that is, the upright post structure in embodiment 1, embodiment 2, embodiment 3 and embodiment 4 can be used in the technical field of the automobile elevator.

The above contents are merely preferred embodiments of the invention, for those of ordinary skill in the art, many changes may be made to the specific embodiments and application ranges according to the idea of the technical contents, and as long as these changes do not deviate from the concept of the invention, they all fall within the protection scope of the present patent.

The invention claimed is:

1. An upright post structure, wherein the upright post structure is a polygonal columnar structure formed by bending a plate, the upright post structure comprising a back plate, both ends of the back plate in a width direction vertically extend toward the same side of the back plate to form a side plate, and end parts of the side plate away from the back plate extend oppositely to form a front plate, wherein the upright post structure further comprises the following features:

a joint of the side plate and the front plate is bevelled, and an extension surface formed at the bevelled location is a front sloping plate, wherein an included angle between the front plate and the side plate has a buffer structure, and the buffer structure is used for reducing the possibility of deformation or deformation degree of the side plate caused by an external force;

the back plate has a first groove for enhancing the strength of the upright post and installing wirings and an electromagnetic lock; and the side plate has a folded-back structure, and the folded-back structure is a groove structure or a convex structure, wherein the upright post structure further comprises one or more edgefold formed at an included angle between the front plate and the side plate, and the front plate, the side plate and the one or more edgefold are enclosed to form a closed structure as the buffer structure, wherein an end section or a part of an extended section of the one or more edgefold abuts against the side plate or the front plate.

2. The upright post structure according to claim 1, wherein the one or more edgefold comprises a first edgefold, a second edgefold and a third edgefold, wherein an inner side of the front plate extends toward a direction vertical to the back plate to form the first edgefold, one side of the first edgefold facing to the back plate extends toward the side plate to form the second edgefold, one side of the second edgefold facing to the side plate extends toward the front plate to form the third edgefold, the third edgefold abuts against an inner wall of the side plate, and the first edgefold, the second edgefold and the third edgefold form the buffer structure.

3. The upright post structure according to claim 1, wherein an included angle formed by a side wall formed by the folded-back structure and a main extension surface where the folded-back structure is located has a chamfer structure.

4. The upright post structure according to claim 1, wherein the upright post structure is a symmetrical structure along a plane vertical to a longitudinal center of the back plate.

5. An automobile elevator, comprising an upright post structure, wherein the upright post structure is a polygonal columnar structure formed by bending a plate, and wherein the upright post structure comprises a back plate, both ends of the back plate in a width direction vertically extend toward the same side of the back plate to form a side plate, and end parts of the side plate away from the back plate extend oppositely to form a front plate, wherein the upright post structure further comprises the following features:

a joint of the side plate and the front plate is bevelled, and an extension surface formed at the bevelled location is a front sloping plate, wherein an included angle between the front plate and the side plate has a buffer structure, and the buffer structure is used for reducing the possibility of deformation or deformation degree of the side plate caused by an external force;

the back plate has a first groove for enhancing the strength of the upright post and installing wirings and an electromagnetic lock; and the side plate has a folded-back structure, and the folded-back structure is a groove structure or a convex structure, wherein the upright post structure further comprises one or more edgefold formed at an included angle between the front plate and the side plate, and the front plate, the side plate and the one or more edgefold are enclosed to form a closed structure as the buffer structure, wherein an end section or a part of an extended section of the one or more edgefold abuts against the side plate or the front plate.

6. The automobile elevator according to claim 5, wherein the one or more edgefold comprises a first edgefold, a second edgefold and a third edgefold, wherein an inner side of the front plate extends toward a direction vertical to the back plate to form the first edgefold, one side of the first edgefold facing to the back plate extends toward the side plate to form the second edgefold, one side of the second edgefold facing to the side plate extends toward the front plate to form the third edgefold, the third edgefold abuts against an inner wall of the side plate, and the first edgefold, the second edgefold and the third edgefold form the buffer structure.

7. The automobile elevator according to claim 5, wherein an included angle formed by a side wall formed by the folded-back structure and a main extension surface where the folded-back structure is located has a chamfer structure.

8. The automobile elevator according to claim 5, wherein the upright post structure is a symmetrical structure along a plane vertical to a longitudinal center of the back plate.

* * * * *